US005536188A

United States Patent [19]

Porta

[11] Patent Number: 5,536,188

[45] Date of Patent: Jul. 16, 1996

[54] NOSE CONE METHOD AND APPARATUS

[76] Inventor: Scott S. Porta, 117 Wilkinson Dr., Edgewater, Fla. 32132

[21] Appl. No.: 517,736

[22] Filed: Aug. 21, 1995

[51] Int. Cl.[6] ..... B63H 21/24

[52] U.S. Cl. ..... 440/78; 440/76; 440/900

[58] Field of Search ..... 440/76, 78, 900, 440/66, 71, 113

[56] References Cited

U.S. PATENT DOCUMENTS

| | | | |
|---|---|---|---|
| 3,240,181 | 3/1966 | Chandler et al. | 115/17 |
| 3,939,795 | 2/1976 | Rocka | 115/17 |
| 4,752,257 | 6/1988 | Karls et al. | 440/76 |
| 4,767,366 | 8/1988 | Lang | 440/76 |
| 4,832,635 | 5/1989 | McCormick | 440/78 |
| 5,000,709 | 3/1991 | Bergeron | 440/78 |

*Primary Examiner*—Edwin L. Swinehart
*Attorney, Agent, or Firm*—William M. Hobby, III

[57] ABSTRACT

A nose cone attachment for an outboard motor propeller gearcase has a molded polymer housing shaped to fit over the front and sides of an outboard propeller gearcase and has an aerodynamic nosepiece shape on the front thereof with a plurality of water inlets thereon. The molded polymer housing has open water channels or plenums thereinside which form wide passageways with the gearcase housing sides when the nose cone attachment is attached over the gearcase housing. The open water channels are positioned to fit over the gearcase water inlets. The housing is adhesively attached but may also have a plurality of screw openings formed in the side thereof and positioned for attaching screws therethrough to attach the nose cone to a gearcase outboard motor prop. The method of attaching a nose cone to an outboard motor propeller gearcase includes the step of selecting a molded polymer housing in accordance with the apparatus, fitting the selected nose cone over the front of the outboard prop gearcase and aligning the water channels or plenums over the gearcase water inlets and adhesively attaching the selected and aligned molded polymer housing to the gearcase whereby an outboard nose cone is attached to an outboard prop gearcase for feeding water into the cooling system of the outboard prop gearcase.

12 Claims, 1 Drawing Sheet

NOSE CONE METHOD AND APPARATUS

BACKGROUND OF THE INVENTION

The present invention relates to a nose cone attachment for an outboard motor propeller gearcase and to a method of attaching a nose cone to an outboard motor propeller gearcase and especially to a nose cone attachment formed of a molded polymer housing positioned to direct water directly into the side cooling inlets for the prop housing.

Marine drives normally include an outboard positioned drive unit which includes a lower gearcase formed at its lower end and mounted to provide a generally horizontal torpedo housing. In some instances, the water intake openings are provided in the upper portion of the gearcase housing above the propeller driveshaft housing. In other instances, the bore of the propeller shaft housing is closed at its forward end by a conical nose member which includes a plurality of water inlet openings on its periphery. A widely available attachment for marine drives are nose cones adapted to fit over the gearcase of a marine drive lower gearcase. The basic purpose of a nose cone is to streamline the gearcase of the propulsion device so as to increase the top speed and improve the handling of the watercraft. Typically, the nose cone is provided with a streamlined frontal portion and a recessed rear portion for accommodating the gearcase, which is substantially a mirror image of the gearcase to which the nose cone is attached. Because different brands of propulsion devices have different gearcase designs and profiles, a number of different molds for forming a nose cone has been required in the past. One prior art U.S. Pat. No. 5,000,709, to Bergeron, attempts to solve this problem with a universal nose cone which has a cavity with a height, width, and depth dimensions to accommodate a plurality of different watercraft lower housings so that once the nose cone has been suitably profiled, the nosecose can be adhesively secured to the gearcase for which it has been profiled with the edge of the cavity engaging the housing to streamline the lower housing to improve performance of the watercraft. Another prior U.S. Pat. No. 4,832,635, to McCormick, teaches a nose construction for the gearcase of a marine drive which is a part of the marine drive and has a generally cylindrical configuration. This type of nose construction has a plurality of water inlet openings on the nose cone portion of the lower drive shaft of the marine propulsion unit feeding directly into the gearcase.

In the Rocka patent, U.S. Pat. No 3,939,795, an outboard motor protective cover is provided to cover the rudder and propeller shaft portion of the prop unit to increase the strength of the motor parts which are covered and protected against water damage and wear. An opening in the side of the protective cover leaves the side waterlets open to the exterior. Several patents have been directed towards providing intake scoops for water to drive water into the marine drive prop unit for better water cooling. The Lang patent, U.S. Pat. No. 4,767,366, shows a water ram scoop for cooling water intake which provides scoops for better directing the water into the water inlets when the prop unit is moving forward in the water. Each scoop is provided with a water receiving opening leading to a passage for passing water through the scoop towards the water pump. In the B. M. Chandler et al. patent, U.S. Pat. No. 3,240,181, an outboard motor attachment is attached over the side water inlets and has a tube extending therefrom having a scoop on the end thereof which is twisted around to face the outboard motor propeller for driving water directly into the scoop, through the pipe, and into the water inlets of the outboard motor. In the Karls et al. patent, U.S. Pat. No. 4,752,257, a cooling water intake has increased water flow by having water intake plates covering the water inlet opening and having an outer forward lip for directing water into the water inlet openings.

In contrast to these prior patents, the present invention is directed towards a universal nose cone which can be attached to a wide variety of marine propulsion units over the motor prop gearcase to form a more aerodynamic nose cone on the prop and simultaneously to scoop water from the front of the nose cone through the nose done attachment into the side water inlets for greater cooling and to thereby convert the lower prop unit from one having water intake openings on the upper portion of the gearcase to one having a plurality of water inlets located on the forward end of a conical nose member and to substantially increase the cooling of the engine.

SUMMARY OF THE INVENTION

A nose cone attachment for an outboard motor propeller gearcase has a molded polymer housing shaped to fit over the front and sides of an outboard propeller gearcase and has an aerodynamic nosepiece shape on the front thereof with a plurality of water inlets thereon. The molded polymer housing has open water channels or plenums thereinside which form wide passageways with the gearcase housing sides when the nose cone attachment is attached over the gearcase housing. The open water channels are positioned to fit over the gearcase water inlets. The housing is adhesively attached but may also have a plurality of screw openings formed in the side thereof and positioned for attaching screws therethrough to attach the nose cone to a gearcase outboard motor prop. The method of attaching a nose cone to an outboard motor propeller gearcase includes the step of selecting a molded polymer housing in accordance with the apparatus, fitting the selected nose cone over the front of the outboard prop gearcase and aligning the water channels or plenums over the gearcase water inlets and adhesively attaching the selected and aligned molded polymer housing to the gearcase whereby an outboard nose cone is attached to an outboard prop gearcase for feeding water into the cooling system of the outboard prop gearcase. The method also includes the attaching of the threaded fastener through the opening in the housing into the outboard motor propeller gearcase.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
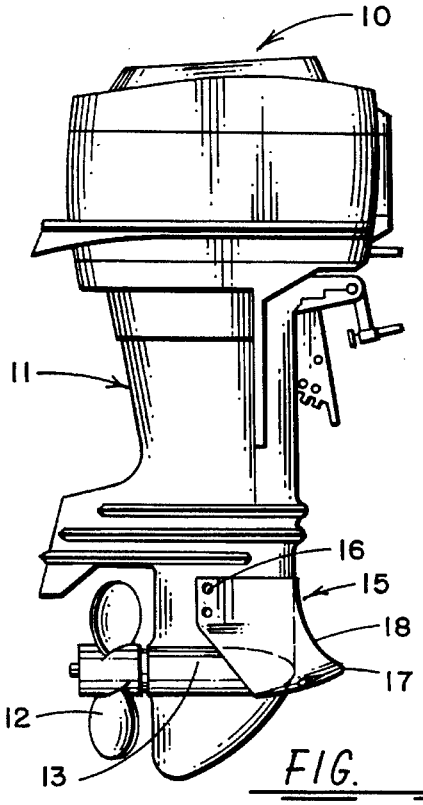
FIG. 1 is a side elevation of an outboard motor having a nose cone in accordance with the present invention attached thereto.
Figure 2:
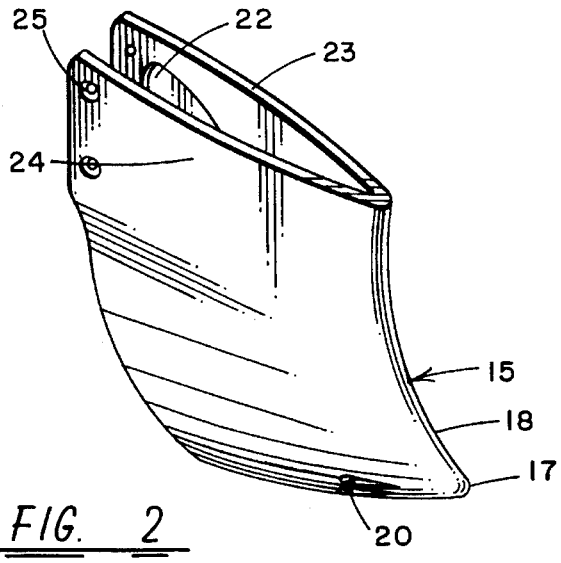
FIG. 2 is a perspective view of a universal nose cone in accordance with the present invention.
Figure 3:
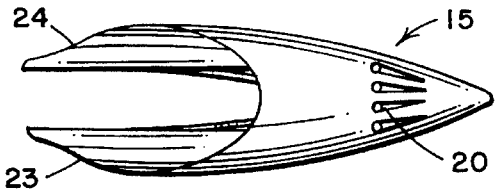
FIG. 3 is a bottom elevation of the nose cone of FIG. 2.
Figure 4:
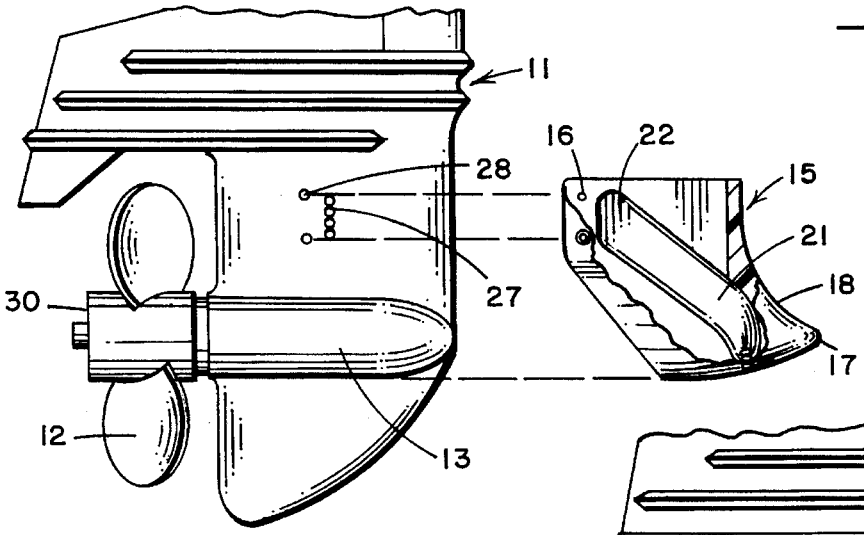
FIG. 4 is an exploded elevation having a portion of the nose cone attachment removed.

Referring to the drawings and especially to FIGS. 1–5, FIG. 1 shows an outboard motor 10 having a marine propulsion or drive unit 11 and having a propeller 12 attached to the propeller gearcase 13 having the gearcase housing 14. A nose cone attachment 15 in accordance with the present invention is shown attached to the front of the gearcase housing 14 and has a pair of threaded fasteners 16 on either side thereof with a aerodynamic pointed nose cone front tip 17 having a curve portion 18 curved to the rest of the body of a nose cone 15. As more clearly seen in FIGS. 2 and 3, the nose cone 15 has a plurality of water inlets 20 feeding therethrough and into a pair of inside open channels or plenums 21 to an inner cavity 22 located inside the nose cone 15 sidewalls 23 and 24. The open channels form a passageway with the sides of the gearcase when the nose cone 15 is attached to the gearcase 13. A pair of threaded openings 25 may pass through the sidewalls 22, 23 and 24 and is used for attaching the nose cone to the gearcase housing 14. The principle method of attaching the nose cone is with an adhesive.

The water cavity 15 is positioned to direct water from the scoop-like openings 20 into the inner open passageway 21. The inner plenum 21 on either side of the nose cone attachment 15 is enlarged and shaped so that it will form a passageway with the side portions 26 of the lower prop unit 15 such that the open channels 21 will fit over the water inlets 27 of the gearcase housing 14. Openings 28 in the side 26 of the prop housing allows for tile attachment of threaded fasteners through the openings 25. Advantageously, the broad channel area 21 is open to the inside walls of the nose cone 15 and are such that they will fit over a wide variety of different water inlets 27 for different brands of outboard motors 10 and prop units with different types of gearcase housings 14. Thus, one unit directs the intake water to a wide variety of intake openings by having the large formed channel 21 forming the passageway with one open side on either side of the inside of the prop unit 15. The open channel areas allow the unit to be molded of a polymer in a standard molding procedure without having to perform inner passageways within the material with the increased complexity and cost of molding and allows the unit to fit and cover most brands of marine drive units having side water inlets in the gearcase housing.

Figure 5:
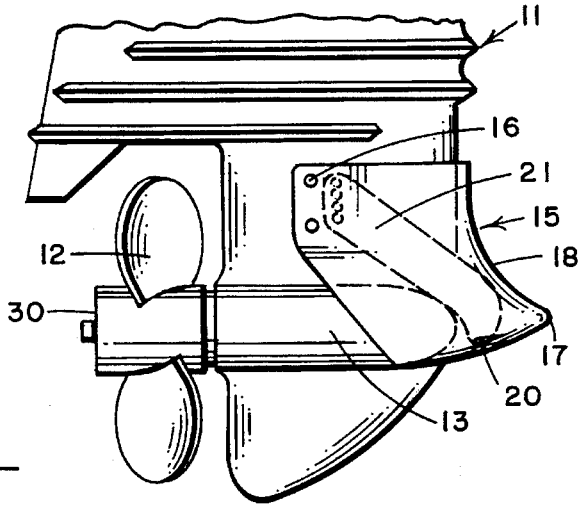
FIG. 5 is a partial elevation of a lower prop unit showing the water passageway from the inlet of the nose cone attachment to the outlet over the water inlets of the prop.

As seen in FIG. 5, the passageway is formed when the unit is attached to the housing so that the gearcase housing forms the inner wall of the passageway, as illustrated in FIG. 5 (in phantom).

It should be clear that a universal nose cone attachment has been provided with a water cooling adapter and formed of a molded polymer unit 15 in accordance with the drawings and can advantageously be slipped onto the front of any marine drive gearcase housing 14 and slid to a position where the water channels 21 slide over the water inlet opening 27 in the side of the prop unit land adhesively attached thereto. Threaded fasteners can be threaded through the openings 25 into the openings 28 to further attach the nose cone attachment 15 to the gearcase housing to allow the adhesive to cure and to provide a more secure attachment of the nose cone 15.

The present invention provides a nose cone which has the integral water passages utilizing the factory water intakes of an outboard prop unit which enables the user to avoid machine work on the prop to add a nose cone which could void the warranty on the outboard unit. However, it should be clear at this time that the present invention as illustrated in the drawings and specification should be considered as illustrative rather than restrictive.

I claim:

1. A method of attaching a nose cone to an outboard motor propeller gearcase comprising the steps of:

selecting a molded polymer housing shaped to fit over the front of an outboard prop gearcase and having a nose piece on the front thereof having a plurality of water inlets thereon, said selected molded polymer housing also having water outlets positioned to fit over the gearcase water inlets;

fitting said selected nose cone over the front of an outboard prop gearcase and aligning said water outlets over the gearcase water inlets to form a passageway between the molded polymer housing water inlets and the gearcase water inlets; and adhesively attaching said selected and aligned molded polymer housing to said gearcase, whereby an outboard nose cone is attached to an outboard prop gearcase for feeding water into the cooling system of said outboard prop gearcase.

2. A method of attaching a nose cone to an outboard motor propeller gearcase in accordance with claim 1 in which the step of selecting a molded polymer housing includes selecting a housing having a pair of open inside channels which form a pair of passageways with the outboard prop gearcase when attached thereto.

3. A method of attaching a nose cone to an outboard motor propeller gearcase in accordance with claim 2 including the step of attaching said nose cone to said gearcase includes attaching a pair of self tapping screws through said molded polymer housing into an outboard prop gearcase.

4. A method of attaching a nose cone to an outboard motor propeller gearcase in accordance with claim 3 in which the step of selecting a molded polymer housing includes selecting a molded polymer housing having a nose piece having a plurality of scoop shaped water inlets.

5. A method of attaching a nose cone to an outboard motor propeller gearcase in accordance with claim 4 in which the step of selecting a molded polymer housing includes selecting a molded polymer housing having a pair of apertures therein and attaching said self tapping screws therethrough.

6. A method of attaching a nose cone to an outboard motor propeller gearcase in accordance with claim 5 in which the step of selecting a molded polymer housing includes selecting a molded polymer housing having an aerodynamic shaped nose piece.

7. A method of attaching a nose cone to an outboard motor propeller gearcase in accordance with claim 6 in which the step of selecting a molded polymer housing includes selecting a molded polymer housing having a nose piece having a curved top.

8. A method of attaching a nose cone to an outboard motor propeller gearcase in accordance with claim 7 in which the step of selecting a molded polymer housing includes selecting a molded polymer housing having said water inlets located in said nose piece curved top.

9. A nose cone attachment for an outboard motor propeller gearcase comprising:

a molded polymer housing shaped to fit over the front and sides of an outboard prop gearcase and having an aerodynamic nose piece on the front thereof, said nose piece having a plurality of water inlets thereon, and said molded polymer housing having at least one open water channel positioned thereinside and connected to said nose piece water inlets and positioned to fit over the sides of said outboard prop gearcase and over said gearcase water inlets to form a passageway with said gearcase sides connecting said water inlets and said gearcase water inlets, whereby an outboard nose cone is shaped for attachment to an outboard prop gearcase for feeding water into the cooling system of said outboard prop gearcase.

10. A nose cone attachment for an outboard motor propeller gearcase in accordance with claim 9 in which said nose piece water inlets are scooped shaped.

11. A nose cone attachment for an outboard motor propeller gearcase in accordance with claim 9 in which said molded polymer housing nose piece has a curved portion curved onto the front of said housing.

12. A nose cone attachment for an outboard motor propeller gearcase in accordance with claim 9 in which said molded polymer housing has a plurality of screw openings formed in the side thereof positioned for attaching screws therethrough to attach said nose cone to the gearcase of an outboard motor prop.

* * * * *